US007500334B2

(12) United States Patent
Stevens

(10) Patent No.: US 7,500,334 B2
(45) Date of Patent: Mar. 10, 2009

(54) ACCESS TOWER

(76) Inventor: John Timothy Stevens, The Coppice, 1 Home Farm Close, Abbots Ripton, Huntingdon, Cambridgeshire PE28 2PT (GB)

( * ) Notice: Subject to any disclaimer, the term of this patent is extended or adjusted under 35 U.S.C. 154(b) by 84 days.

(21) Appl. No.: 11/437,503

(22) Filed: May 19, 2006

(65) Prior Publication Data

US 2007/0266668 A1 Nov. 22, 2007

(51) Int. Cl.
*B66C 23/62* (2006.01)

(52) U.S. Cl. ..... 52/117

(58) Field of Classification Search ..... 52/633, 52/109, 118, 646, 117; 182/163, 152
See application file for complete search history.

(56) References Cited

U.S. PATENT DOCUMENTS 1,222,200 A * 4/1917 Grandinetti ..... 182/148
2,948,363 A * 8/1960 Hopfeld ..... 182/141
3,701,226 A * 10/1972 Fulcher ..... 52/109
4,657,113 A 4/1987 Costello
5,184,444 A * 2/1993 Warden ..... 52/646
2004/0174030 A1 * 9/2004 Sentenne ..... 296/24.3

FOREIGN PATENT DOCUMENTS

| | | |
|---|---|---|
| DE | 19991012050 | 3/1999 |
| GB | 2408285 | 5/2005 |
| GB | 2434396 | 7/2007 |

* cited by examiner

*Primary Examiner*—Richard E Chilcot, Jr.
*Assistant Examiner*—Anthony N Bartosik
(74) *Attorney, Agent, or Firm*—DeLio & Peterson, LLC; Peter W. Peterson

(57) ABSTRACT

An access tower has two mutually spaced side parts extending from a base part to the top part; and inclined cross parts each extending from one side part to the other. The cross parts are arranged one above another and inclined in opposite senses. The cross parts are rigid and are connected to the side parts. The lower one of two successive oppositely inclined cross parts has its upper end connected to an articulation node to which the lower end of the upper one of said two successive oppositely inclined cross parts is connected. A section of the side part opposite said articulation node, which section extends between the upper end of said upper cross part and the lower end of said lower cross part, is collapsible so that said upper cross part together with the portion of the tower above it can be lowered into a position in which said upper cross part extends substantially parallel to said lower cross part. A releasable locking device is provided to prevent collapse of said collapsible section.

16 Claims, 10 Drawing Sheets

ACCESS TOWER

BACKGROUND TO THE INVENTION

Mobile access towers are used to provide a platform for safe working at heights. They conventionally consist of a variety of loose individual components slotted together by hand to form square or rectangular staging. Further components are used to brace the staging in the horizontal and vertical plane. Additional height is gained by repeating the process whereby a second set of staging is mounted upon the first set. As more height is required the task of lifting individual components up to the elevated height becomes more laborious and time consuming.

SUMMARY OF THE INVENTION

The present invention provides an access tower comprising: a base part; a top part; two mutually spaced side parts extending from the base part to the top part; and inclined cross parts each extending from one side part to the other and having an upper end and a lower end, the inclined cross parts being arranged one above another and inclined in opposite senses, the inclined cross parts being rigid and being connected to the side parts; wherein the lower one of two successive oppositely inclined cross parts has its upper end connected to an articulation node to which the lower end of the upper one of said two successive oppositely inclined cross parts is connected, a section of the side part opposite said articulation node, which section extends between the upper end of said upper inclined cross part and the lower end of said lower inclined cross part, being collapsible so that said upper inclined cross part together with the portion of the tower above it can be lowered into a position in which said upper inclined cross part extends substantially parallel to said lower inclined cross part, a releasable locking device being provided to prevent collapse of said collapsible section.

DETAILED DESCRIPTION OF THE EMBODIMENTS

Figure 1:
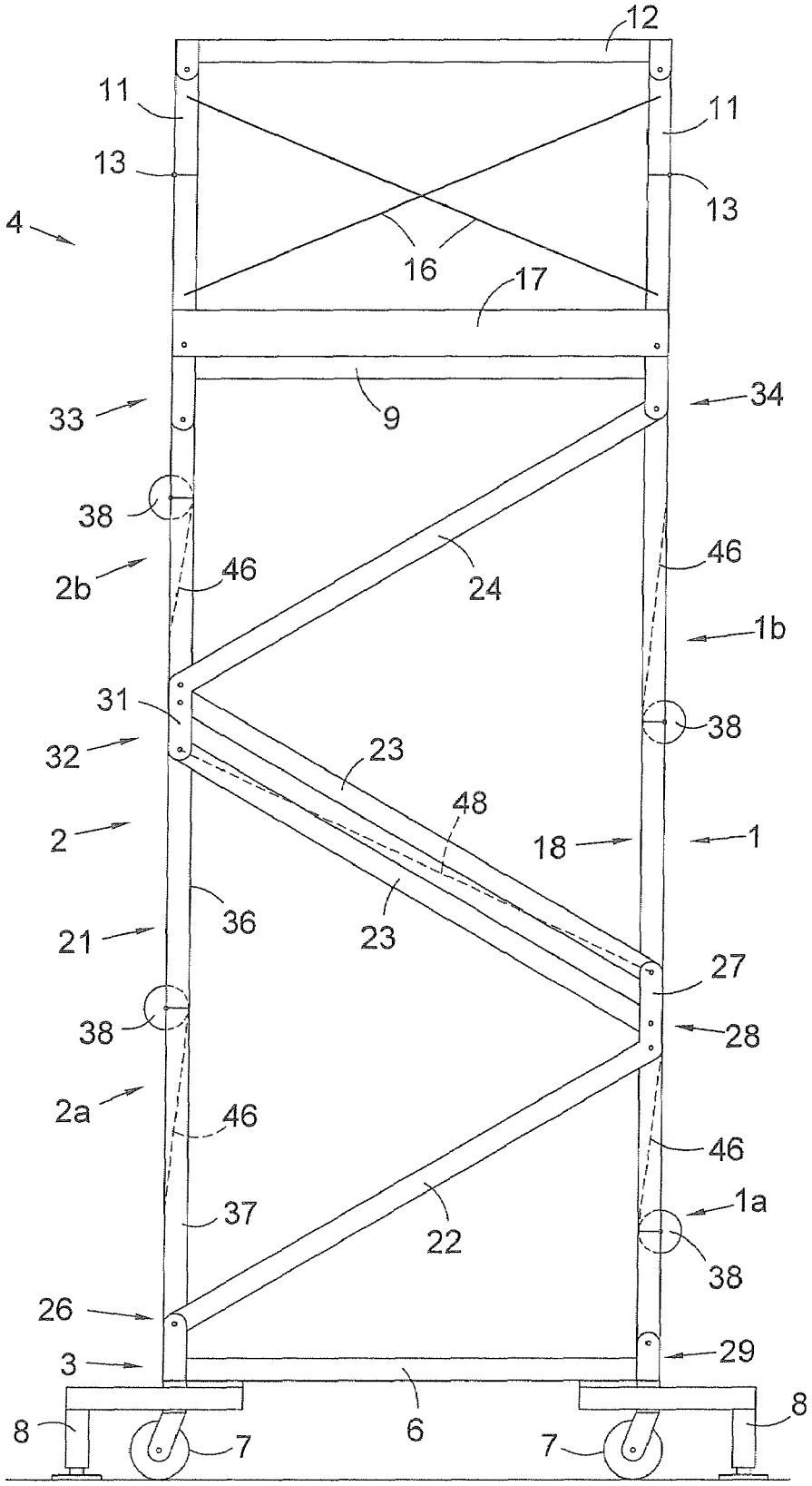
FIG. 1 is a front elevation of a preferred embodiment of an access tower in accordance with the invention, shown at full working height.

The access tower illustrated in FIGS. 1 to 9 comprises two mutually spaced side parts 1, 2 extending from a base part 3 to a top part 4. The base part 3 comprises a generally rectangular frame 6 provided with four lockable castors 7 and four stabilizers or outriggers 8 which are movable from a working position (FIGS. 1, 2, 4, 5), in which they lie outside the frame 6, and a non-working position (FIG. 3), in which they lie inside the frame 6 and out of contact with the ground.

The top part 4 comprises a generally rectangular working platform 9 with an access hatch. Four uprights 11 support a handrail 12 extending around the working space above the platform 9. Each upright 11 is collapsible to bring the handrail 12 closer to the platform 9 for transport and storage. Each upright 11 folds about a hinge 13 and is releasably lockable in the extended position, e.g. by the type of locking device described below. Pairs of uprights 11 on opposite sides of the access tower are connected by horizontal safety rails 14. Flexible elements 16, such as wires or cables, are connected between the opposite pairs of uprights 11. Toe boards 17 (preferably made of resilient plastics material) are mounted on the periphery of the working platform 9, outside the uprights 11.

The right-hand side part 1 (as viewed in FIG. 1) is in the form of two mutually parallel columns 18 connected by rigid horizontal members 19 so as to constitute a ladder. The left-hand side part 2 also presents two mutually parallel columns 21. In the presently described embodiment there is a free space between the columns 21, allowing access to the ladder (18/19) from inside the access tower.

At the front and back of the access tower there are inclined rigid cross parts 22-24, each extending from one of the side parts 1, 2 to the other. A first or lower inclined cross part 22 has its lower end pivotally connected to the base part 6 at an articulation node 26, and a lower end of the side part 2 is also pivotally connected to the base part 6 at the same articulation node 26; the pivot axes do not necessarily coincide. The upper end of the first or lower cross part 22 is rigidly connected to an upright part 27 to which lower ends of a pair of second or upper inclined cross parts 23 are pivotally connected, at an articulation node 28. A lowermost section 1*a* of the right-hand side part 1 has its lower end pivotally connected to the base part 6 at an articulation node 29 and has its upper end pivotally connected to the upper end of the first inclined cross part 22 at the articulation node 28.

The upper ends of the second or upper inclined cross parts 23 are pivotally connected to an upright part 31, at an articulation node 32. A lowermost section 2*a* of the side part 2 (opposite the articulation node 28) has its upper end pivotally connected to the lower end of the upright part 31, at the articulation node 32. An uppermost section 2*b* of the side part 2 has its lower end pivotally connected to the upper end of the upright part 31, at the articulation node 32, and has its upper end pivotally connected to the top part 4 at an articulation node 33.

A further or third inclined cross part 24 has its lower end rigidly connected to the upper end of the upright part 31 and has its upper end pivotally connected to the top part 4 at an articulation node 34. An uppermost section 1*b* of the side part 1 (opposite the articulation node 32) has its lower end pivotally connected to the upper end of the upright part 27, at the articulation node 28, and has its upper end pivotally connected to top part 4 at the articulation node 34.

Figure 2:
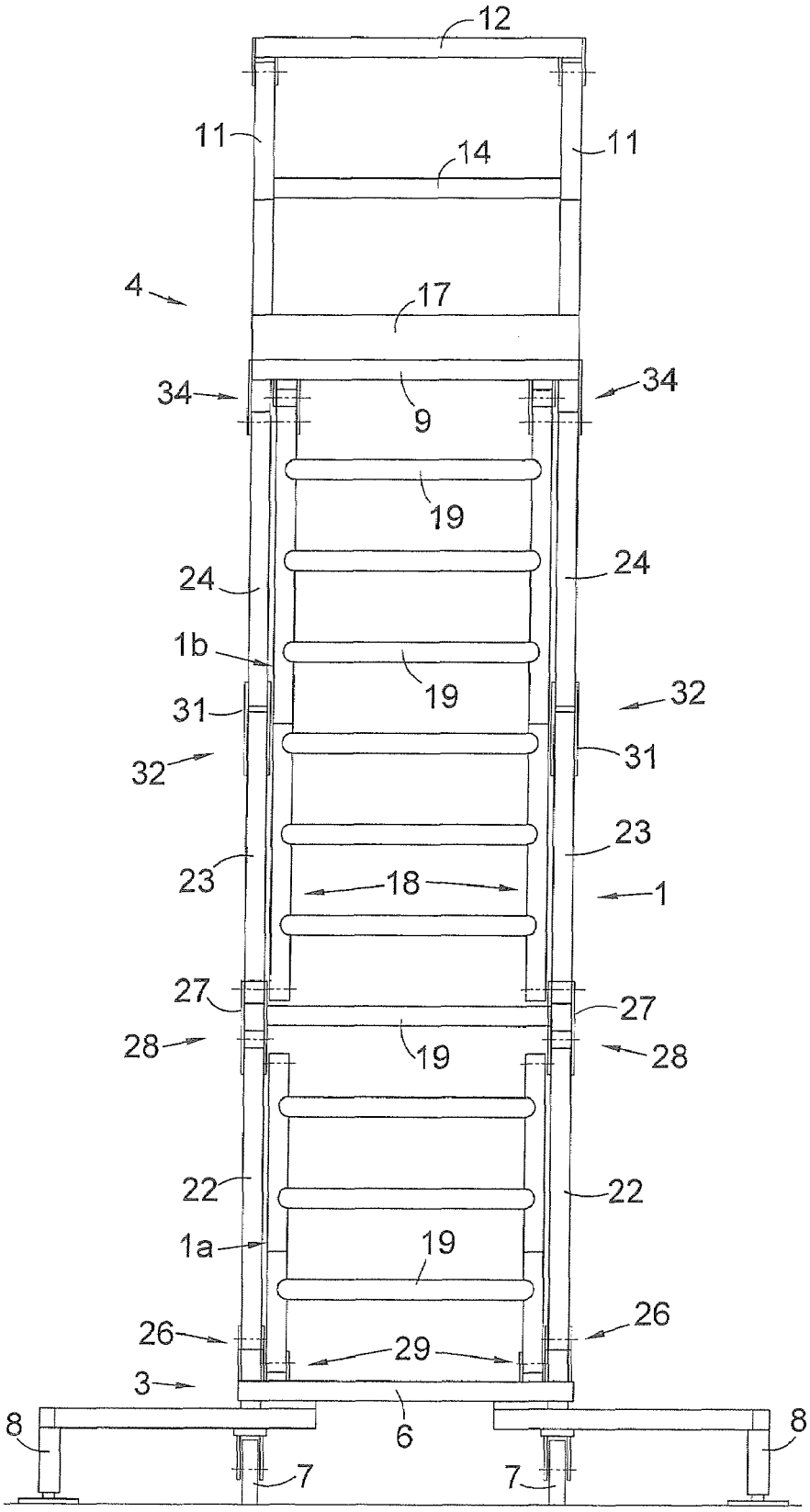
FIG. 2 is a side view of the access tower.

As best seen in FIG. 2, the inclined cross parts 22-24 lie outside the columns of the side parts 1, 2. In the present embodiment there are inclined cross parts at both the front and the back. However, it may be possible for one set of cross parts to be omitted and for the inclined cross parts to be positioned between the columns of the side parts.

The sections 1*a*, 1*b*, 2*a*, 2*b* are each collapsible. In the present embodiment they are each foldable. In particular, taking section 2*a* as an example, as shown in FIGS. 1 and 6 to 9, they each comprise a first or upper portion 36 and a second or lower portion 37 pivotally connected together by a hinge 38 (FIG. 1) which allows folding in one direction only (inwards, towards the opposite side part, in the present embodiment). The hinge (FIGS. 6 to 9) comprises a disc 39 on the first portion 36 mounted between a pair of lugs 41 on the second portion 37 by means of a pivot pin (not shown). A locking lever 42 is pivotally mounted on the second portion 37 so as to be movable between a locking position (shown in solid line in FIG. 9), in which it is selectively engageable with a first notch 43 in the disc 39 to prevent collapse of the foldable section and with a second notch 44 to prevent unfolding of the collapsed section during transit, and a release position (shown in broken line).

To assist in erection of the tower, the second section 37 contains a spring-loaded tension element 46 which is received in a peripheral groove 47 in the disc 39 and is connected to the first section 36 so that the tension element 46 is wound on to the disc 39 as the section is collapsed (folded). Thus the tension element 46 resists collapse and, conversely, assists erection of each section 1*a*, 1*b*, 2*a*, 2*b*.

Figure 3:
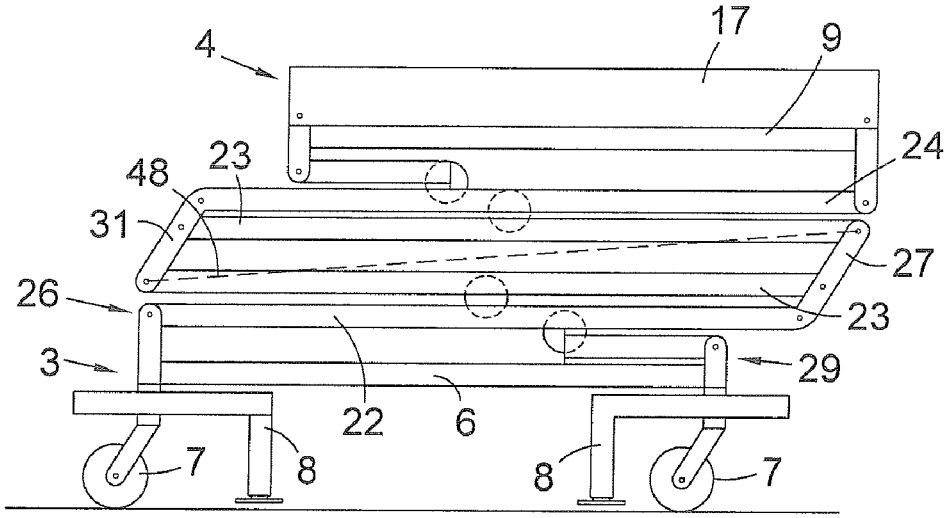
FIG. 3 is a front elevation of the access tower in a collapsed state.

FIG. 3 shows the fully collapsed condition of the access tower. The top part 4 has been collapsed by folding the uprights 11 inwards about their hinges 13. The sections 1*a*, 1*b*. 2*a*, 2*b* of the side parts 1, 2 have been collapsed by folding them inwards about their hinges 38. The inclined cross parts 22-24 extend substantially parallel to one another.

Figure 4:
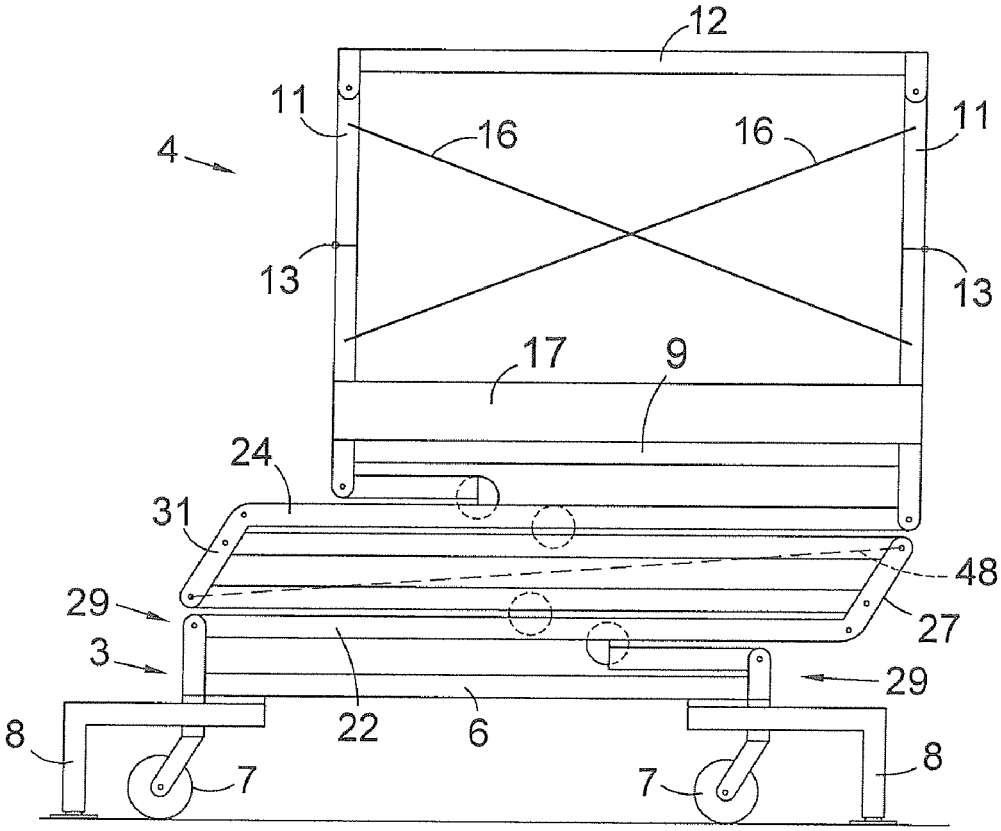
FIG. 4 is a front elevation of the access tower in a partly erected state.

To erect the access tower, referring first to FIG. 4, the castors 7 are first locked and the outriggers 8 are deployed, so that the base part 3 is stable. Then the hand rail 12 is raised while the uprights 11 are unfolded and then locked.

Figure 5:
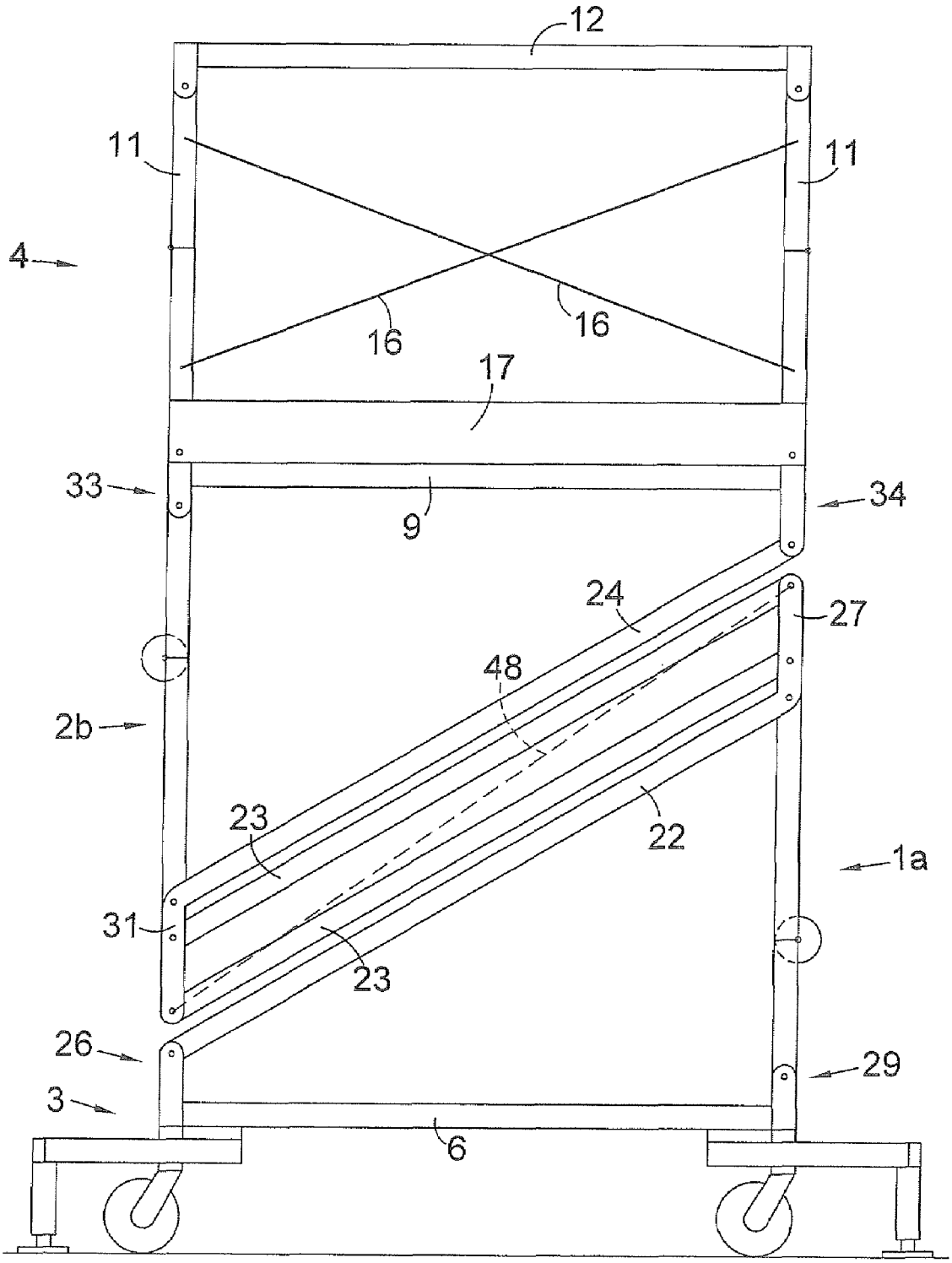
FIG. 5 is a front elevation of the access tower in intermediate erected state, providing an intermediate working height smaller than the full working height.
Figure 6:
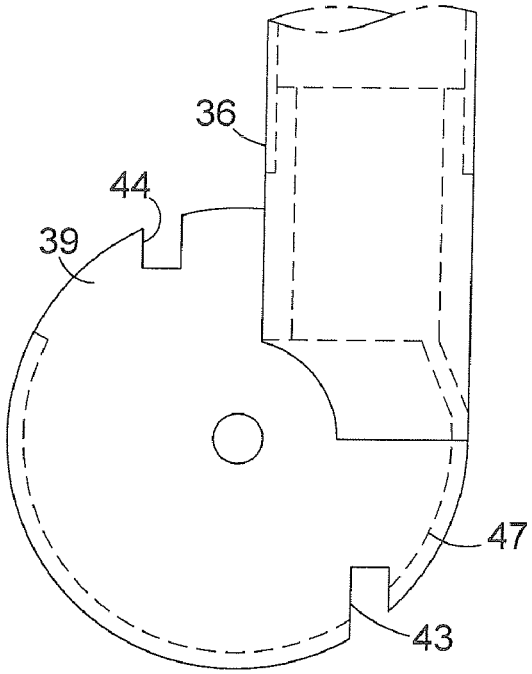
FIG. 6 is an enlarged front elevation of the tower end part of an upper portion of a collapsible section of the access tower.
Figure 7:
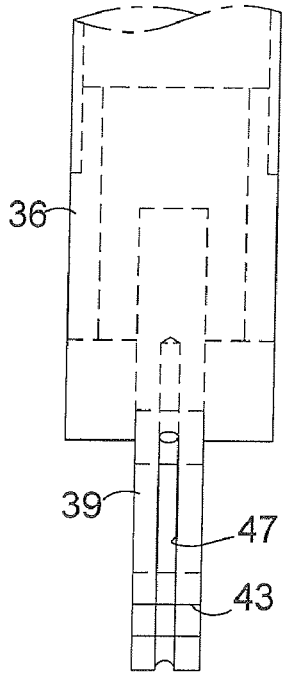
FIG. 7 is a side view of the part shown in FIG. 6.
Figure 8:
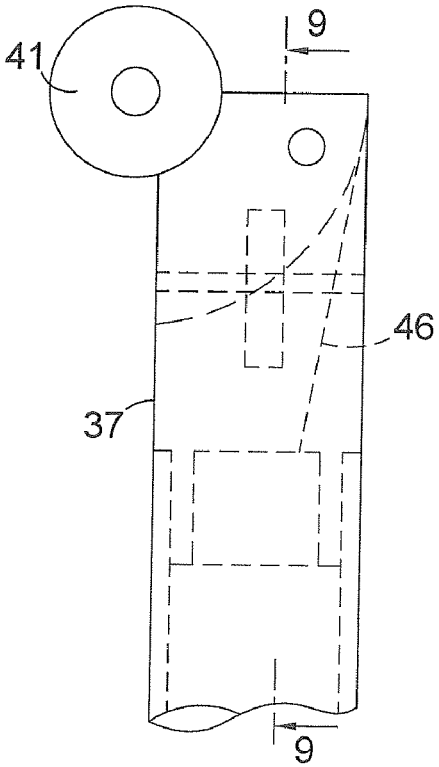
FIG. 8 is an enlarged front elevation of the upper end part of a lower portion of the above-mentioned collapsible section.
Figure 9:
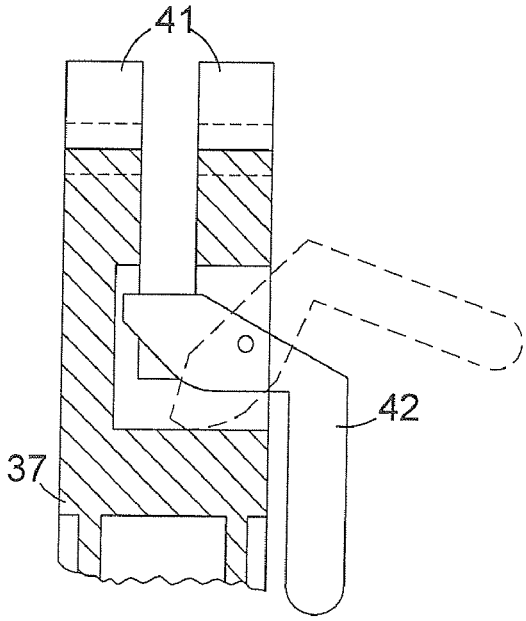
FIG. 9 is a section on line 9-9 in FIG. 8.

Referring now to FIG. 5, the lowermost section 1*a* of the side part 1 and the uppermost section 2*b* of the side part 2 are unfolded and locked. In this condition the access tower is in an intermediate erected state, providing an intermediate working height which is smaller than the full working height. The top part 4 is accessible by climbing up the outside of the partly-erected side part 1.

To fully erect the access tower, the remaining sections 2*a*, 1*b* are unfolded and locked, so that the condition shown in FIGS. 1 and 2 is achieved. It will be noted that the two second cross parts 23 and the upright parts 27, 31 together constitute a parallelogram mechanism which links the third cross part 24 to the first cross part 22 so that, as the third cross part 24 is raised (or lowered), it remains substantially parallel to the first cross part 22. Consequently, the working platform 9 remains level as it is moved between the intermediate height (FIG. 5) and the full height (FIG. 1).

The parallelogram mechanism (23, 27, 31) includes a tension spring 48 which assist in raising the third cross part 24. In the fully erected state (FIG. 1) the tension spring 48 extends along the smaller diagonal of the parallelogram; as the cross parts 23, 24 are lowered this diagonal becomes the larger one (see FIGS. 3 to 5), so that tension is built up in the tension spring 48. It is to be noted that one or more springs could be provided at different locations in the parallelogram mechanism to achieve the same effect.

To further assist erection of the access tower, torsion springs could be provided in one or more of the pivotal connections at one or more of the articulated nodes 26, 28, 29, 32, 33, 34, the torsion spring being mounted externally or in a hub of the pivotal connection.

Figure 10:
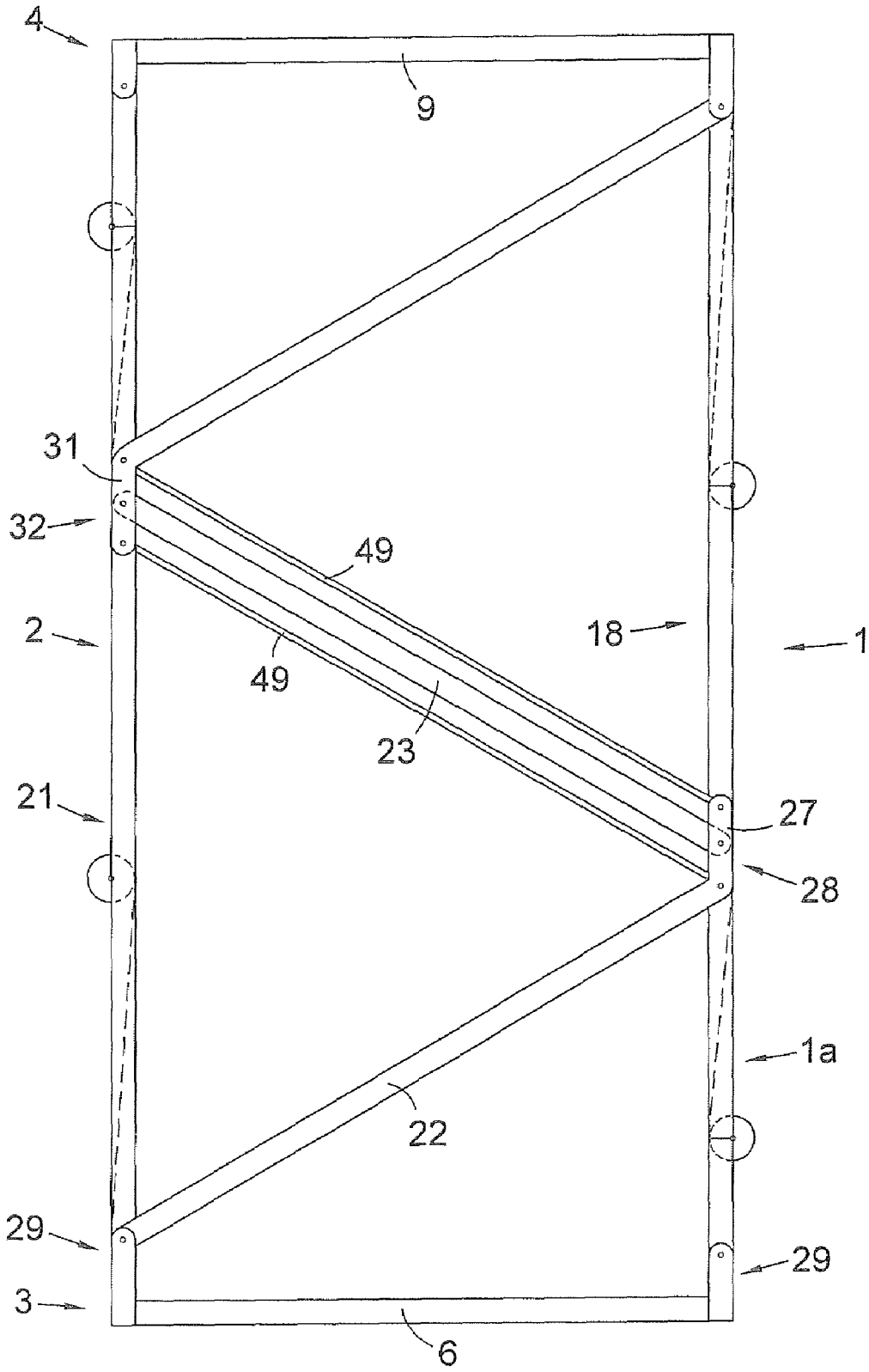
FIG. 10 is a front elevation of part of a second embodiment of the access tower.

A second embodiment of the access tower, shown in FIG. 10, differs from the first embodiment only in the construction of the parallelogram mechanism. In the second embodiment the uprights 27, 31 are connected by a single inclined cross part 23 and by a pair of mutually parallel flexible parts 49, such as wires or cables. The resulting parallelogram mechanism may be provided with a tension spring (48) as described above.

Figure 11:
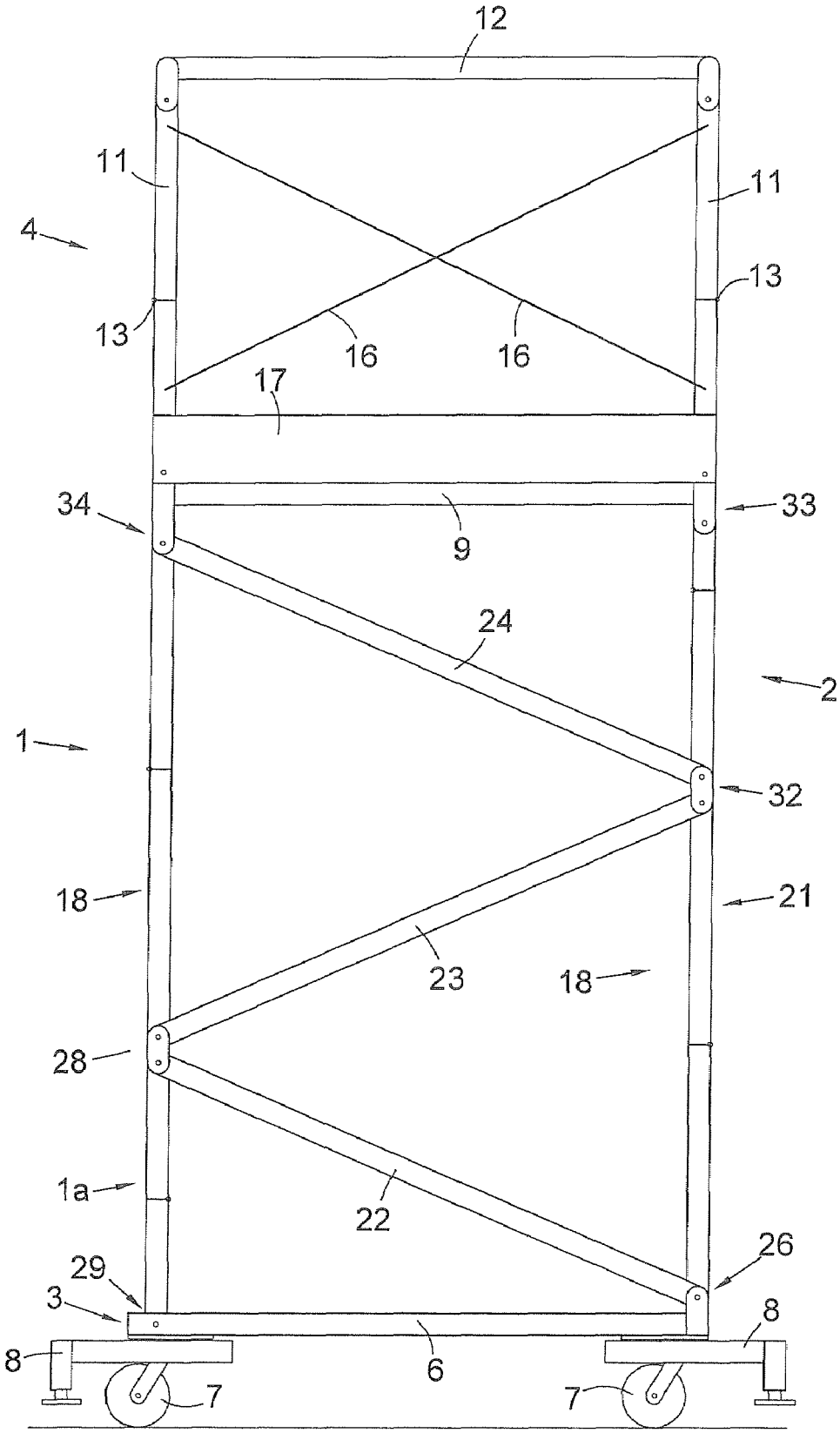
FIG. 11 is a front elevation of a third embodiment of the access tower.
Figure 12:
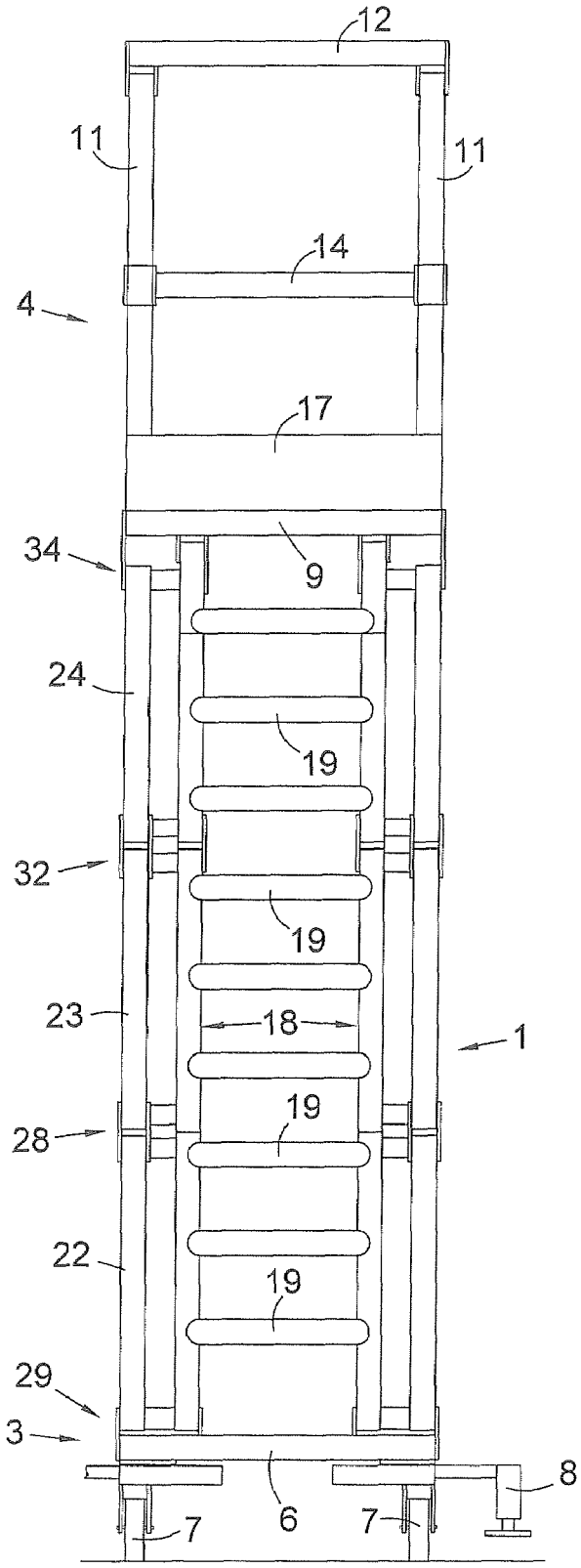
FIG. 12 is a side view of the third embodiment.

A third embodiment of the access tower, shown in FIGS. 11 and 12, differs from the first embodiment in that there is no parallelogram mechanism. A single second inclined cross part 23 replaces the pair of cross parts 23 of the first embodiment. The overall height is less than that of the first embodiment.

Figure 13:
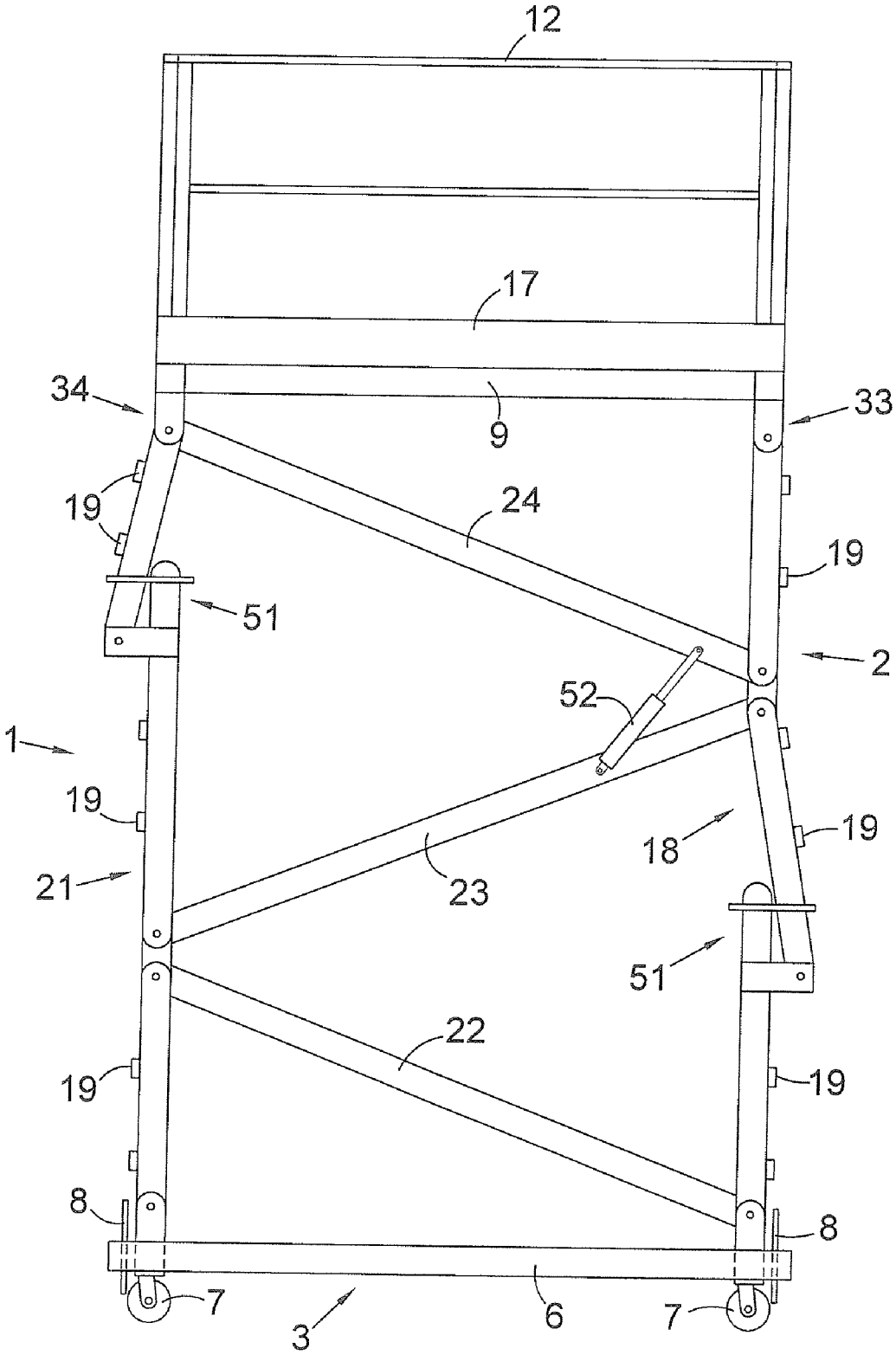
FIG. 13 is a front elevation of a fourth embodiment of the access tower.
Figure 14:
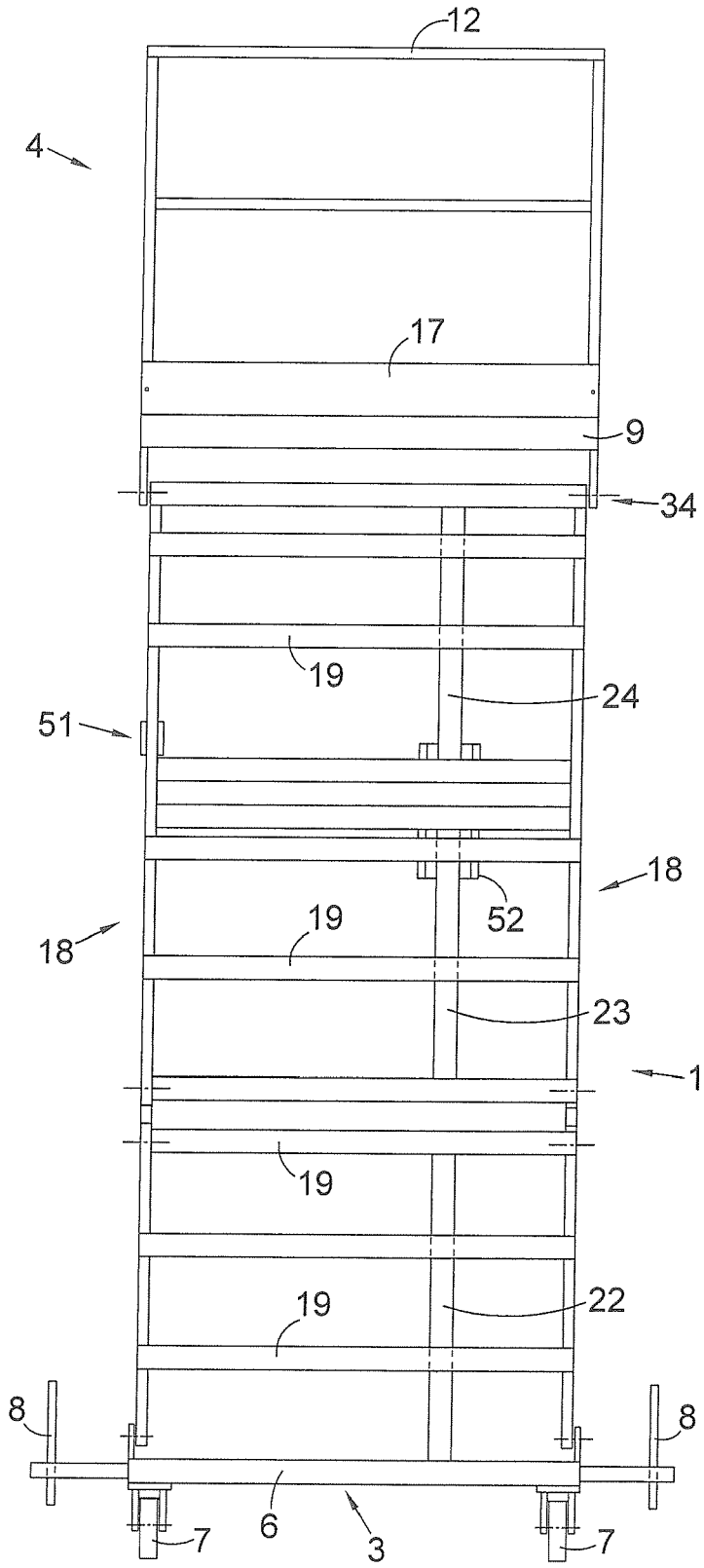
FIG. 14 is a side view of the fourth embodiment.

A fourth embodiment of the access tower is shown in FIGS. 13 and 14 to illustrate an alternative locking device 51 and a piston and cylinder device 52 (for releasing stored potential energy to assist in erection of the access tower) in an access tower which is similar to the third embodiment but has only a single set of inclined cross parts 22-24, arranged between the columns of the side parts 1, 2.

The embodiments described above have been provided by way of example only. Various modifications may be made within the scope of the invention.

For example, although the collapsible sections have been described as foldable, one or more of them could be collapsed in another convenient way, e.g. telescopically. Instead of being foldable inwardly, one or more of the foldable sections may be foldable outwardly, if desired. One or more of the foldable sections may be made up of more than two portions hinged together.

The hinge arrangement shown in FIGS. 6 to 9 could be replaced by a simple hinge connecting the first and second portions of the collapsible section, and a releasable locking device and an associated tension spring could be positioned between the columns of the side parts.

To increase the maximum working height of the access tower, yet more collapsible sections and inclined cross parts may be added to the structure.

I claim:

1. An access tower comprising:

a base part;

a top part;

two mutually spaced side parts extending from the base part to the top part, and inclined cross parts each extending from one side part to the other and having an upper end and a lower end, the inclined cross parts being arranged one above another and inclined in opposite senses, the inclined cross parts being rigid and being connected to the side parts;

wherein the lower one of the two successive oppositely inclined cross parts has its upper end attached to an articulation node to which the lower end of the upper one of said two successive oppositely inclined cross parts is attached; and the articulation node further being attached to one of the side parts, a section of the side part opposite said articulation node, which section extends between the upper end of said upper inclined cross part and the lower end of said lower inclined cross part, being collapsible so that said upper inclined cross part together with the portion of the tower above it can be lowered into a position in which said upper inclined cross part extends substantially parallel to said lower inclined cross part, a releasable locking device being provided to prevent collapse of the collapsible section, said section comprising an upper portion and a lower portion which are pivotally attached together, and the locking device comprising a lever which is mounted on one said portion and which is movable between a locking position, in which it is engageable with the other said portion to prevent collapse of said section, and a release position.

2. An access tower as claimed in claim 1, wherein the lower end of a further inclined cross part is connected to a further articulation node to which the upper end of said upper inclined cross part is connected, a section of the side part opposite said further articulation node, which section extends between the upper end of said further inclined cross part and the lower end of said upper inclined cross part, being collapsible so that said further inclined cross part together with the portion of the tower above it can be lowered into a position in which said further inclined cross part extends substantially parallel to said upper inclined cross part.

3. An access tower as claimed in claim 2, further comprising a parallelogram mechanism which links said further inclined cross part and said lower inclined cross part so that they remain substantially parallel to each other as said further inclined cross part and upper inclined cross part are lowered and raised.

4. An access tower as claimed in claim 3, wherein said parallelogram mechanism includes at least one spring which resists lowering of said further inclined cross part and upper inclined cross part.

5. An access tower as claimed in claim 3, wherein the parallelogram mechanism includes first and second upright parts each having an upper end portion and a lower end portion, the upper end portion of the first upright part being rigidly connected to the lower end of said further inclined cross part, the lower end portion of the first upright part being pivotally connected to the upper end of the first-mentioned collapsible section, the lower end portion of the second upright part being rigidly connected to the upper end of said lower inclined cross part, the upper end portion of the second upright part being pivotally connected to the lower end of the second-mentioned collapsible section.

6. An access tower as claimed in claim 5, wherein the first and second upright parts are connected by a pair of mutual parallel inclined cross parts constituting parts of the parallelogram mechanism.

7. An access tower as claimed in claim 5, wherein the parallelogram mechanism includes a tension spring connected between the lower end portion of the first upright part and the upper end portion of the second upright part.

8. An access tower as claimed in claim 5, wherein the first and second upright parts are connected by a single inclined cross part and a pair of mutually parallel flexible parts constituting parts of the parallelogram mechanism.

9. An access tower as claimed in claim 1 wherein the collapsible section includes at least one spring which resists collapse.

10. An access tower as claimed in claim 1 wherein the collapsible section is foldable inwards, towards said node, about a hinge intermediate its upper and lower ends.

11. An access tower as claimed in claim 1 wherein one of the side parts includes an uppermost section with an upper end portion articulated to the top part and a lower end portion articulated to the lower end of the uppermost one of the inclined cross parts, the uppermost section being collapsible by folding about a hinge intermediate its upper and lower end portions.

12. An access tower as claimed in claim 1 wherein one of the side parts includes a lowermost section with a lower end portion articulated to the base part and an upper end portion articulated to the upper end of the lowermost one of the inclined cross parts, the lowermost section being collapsible by folding about a hinge intermediate its upper and lower ends.

13. An access tower as claimed in claim 1 wherein the top part comprises a working platform, a hand rail, and uprights supporting the handrail, the uprights being collapsible.

14. An access tower as claimed in claim 13, including flexible elements connected between pairs of the uprights.

15. An access tower comprising:

a base part;

a top part;

two mutually spaced side parts extending from the base part to the top part, and inclined cross parts each extending from one side part to the other and having an upper end and a lower end, the inclined cross parts being arranged one above another and inclined in opposite senses, the inclined cross parts being rigid and being connected to the side parts;

wherein the lower one of the two successive oppositely inclined cross parts has its upper end attached to an articulation node to which the lower end of the upper one of said two successive oppositely inclined cross parts is attached; and the articulation node further being attached to one of the side parts, a section of the side part opposite said articulation node, which section extends between the upper end of said upper inclined cross part and the lower end of said lower inclined cross part, being collapsible so that said upper inclined cross part together with the portion of the tower above it can be lowered into a position in which said upper inclined cross part extends substantially parallel to said lower inclined cross part, a releasable locking device being provided to prevent collapse of the collapsible section, wherein the side part attached to the articulation node includes a uppermost section located above the node with an upper end portion articulated to the top part and a lower end portion articulated to the node and the lower end of the uppermost one of the inclined cross parts, the uppermost section being collapsible by folding about a hinge intermediate its upper and lower end portions.

16. An access tower comprising:

a base part;

a top part;

two mutually spaced side parts extending from the base part to the top part, and inclined cross parts each extending from one side part to the other and having an upper end and a lower end, the inclined cross parts being arranged one above another and inclined in opposite senses, the inclined cross parts being rigid and being connected to the side parts;

wherein the lower one of the two successive oppositely inclined cross parts has its upper end attached to an articulation node to which the lower end of the upper one of said two successive oppositely inclined cross parts is attached; and the articulation node further being attached to one of the side parts, a section of the side part opposite said articulation node, which section extends between the upper end of said upper inclined cross part and the lower end of said lower inclined cross part, being collapsible so that said upper inclined cross part together with the portion of the tower above it can be lowered into a position in which said upper inclined cross part extends substantially parallel to said lower inclined cross part, a releasable locking device being provided to prevent collapse of the collapsible section, wherein the side part attached to the articulation node includes a lowermost section located below the node with a lower end portion articulated to the base part and an upper end portion articulated to the node and the upper end of the lowermost one of the inclined cross parts, the lowermost section being collapsible by folding about a hinge intermediate its upper and lower ends.

* * * * *